US005531349A

United States Patent [19]

Wojcik et al.

[11] Patent Number: 5,531,349

[45] Date of Patent: Jul. 2, 1996

[54] FLIP-TOP CLOSURE

[75] Inventors: Michael A. Wojcik; Michael J. Donnantuono, both of Naperville, Ill.

[73] Assignee: Blistex Inc., Oak Brook, Ill.

[21] Appl. No.: 415,120

[22] Filed: Mar. 29, 1995

Related U.S. Application Data

[63] Continuation of Ser. No. 994,891, Dec. 22, 1992, abandoned.

[51] Int. Cl.[6] ..... B65D 41/16

[52] U.S. Cl. ..... 220/339; 215/237; 215/305; 220/335

[58] Field of Search ..... 215/235, 237, 215/305; 220/335, 339; 222/498, 517, 556

[56] References Cited

U.S. PATENT DOCUMENTS

| | | | |
|---|---|---|---|
| 4,377,247 | 3/1983 | Hazard et al. | 215/235 |
| 4,778,071 | 10/1988 | Fillmore | 215/237 |
| 4,793,501 | 12/1988 | Beck | 220/339 |
| 4,911,324 | 3/1990 | Dubach | 220/339 |
| 4,915,268 | 4/1990 | Lay et al. | 220/339 |
| 5,007,555 | 4/1991 | Beck | 220/339 |
| 5,221,017 | 6/1993 | Cistone et al. | 215/235 |
| 5,354,539 | 10/1994 | Hovatter | 220/339 |

FOREIGN PATENT DOCUMENTS

| | | | |
|---|---|---|---|
| 62144 | 6/1955 | France | 220/339 |

*Primary Examiner*—Gary E. Elkins
*Attorney, Agent, or Firm*—Brezina & Ehrlich

[57] ABSTRACT

A closure for a container is provided which includes a collar engaging the opening of the container, and a removable cap pivotally hinged to the collar by means of a double-fold hinge. When closed, the cap fits over the collar. The arc of travel of the cap as it pivots between its opened and closed position is such that the cap clears the cap engaging portion of the collar and the product in the container. The upper surface of the cap includes a chordal ridge which is adapted to be engaged by thumb pressure enabling easy grasping and opening of the container using one hand.

12 Claims, 2 Drawing Sheets

FLIP-TOP CLOSURE

This is a continuation of application Ser. No. 07/994,891, filed on Dec. 22, 1992 now abandoned.

FIELD OF THE INVENTION

The present invention relates generally to a flip top closure for a container, and more particularly to a cap, collar and hinge assembly for a container which permits the cap to be readily opened and closed with one hand without disturbing the contents of the container and enables the cap to lie flat relative to the container opening when the cap is pivoted to its open position. Also, the novel design of the present closure avoids the premature opening of the cap.

BACKGROUND OF THE INVENTION

Many consumer and over the counter drug products are packaged in small hand held containers, with removable closure caps to retain the freshness of the product, or of the active ingredients in the case of over-the-counter drug products, between uses of the product. As one example, topically applied medicated lip balm is often packaged in a hand-held cylindrical hollow tube with a removable closure cap. In a typical construction, the lip balm is embodied in a wax-like substance and is elevated through an opening in the upper end of the tube by rotating a screw thread element which extends into the bottom of the wax-like substance. The screw thread element is typically rotated by means of a knurled wheel extending from the bottom of the tube. A removable closure cap usually fits snugly over the opening of the tube.

In the case of treatment products imbedded in a wax-like carrier substance as described above, a portion of the wax-like substance normally remains protruding about one-eighth inch from the top of the container after use. Thus, the cap must provide a clearance between the inner surface of the top of the cap and the upper rim or opening of the cylindrical tube so as not to contact and depress the waxy substance under normal conditions when the cap is closed over the open end of the tube.

Many prior caps provided with tube-like and other containers for topically applied consumer or medicinal products are completely removable when the contents of the container are to be used. Tubes previously in use would often be held in one hand while the cap would be grasped in the fingers of the other hand, thus requiring two hands to open the container. Often a product such as a medicated lip balm is applied by a user when outside on a cold or raw day, where only one hand, and more than likely a gloved hand, may be available to reach the container for the product, and then to open the container. It is inconvenient to use prior products under such conditions, since two hands are required to hold and open these containers.

Another disadvantage of containers where the cap is completely removable is that the cap can become easily misplaced, soiled or lost after it is removed from the container. This is true particularly when attempting to apply a medicated lip balm on those occasions when both hands are not totally free.

A further disadvantage of containers of the type described with removable closure caps is that if not designed properly, the cap can become dislodged from the container while the product is still in the users pocket or handbag, thereby potentially soiling the clothes or a handbag of the user, or potentially contaminating the remaining product within the container.

The closure cap of the prior containers described above is not designed for one hand or thumb pressure opening. Thus, there is a need for a closure cap for a product container which is designed to be operated with thumb pressure, using the thumb of the same hand that is holding the container. There is further a need for such a closure cap which will not become lost, dropped or soiled after being lifted to open the container, or which will not accidentally become dislodged while in the pocket or handbag of a user, potentially contaminating the product within the tube.

SUMMARY OF THE INVENTION

It is an object of the present invention to provide a closure cap for a product container which cap can be lifted for opening the container by using thumb pressure applied with the thumb of the same hand that is holding the container, thereby enabling single handed operation of the closure cap, even where the operational capability of the hand is inhibited under circumstances where a glove is being worn.

Another object of the invention is to provide a closure cap for a product container which cap is lifted for opening the container by thumb pressure, and the cap remains attached to the container and cannot be misplaced, soiled or lost and cannot come into contact with an object that would contaminate either the cap or the product in the container.

A further object of the present invention is to provide a closure cap for a product container which cap is specifically constructed to convert thumb pressure to rotative movement of the cap about a hinge element connecting the cap to the container, whereby the cap rotates about the hinge and clear of the opening of the container and is typically clear of the product in the container.

Yet another object of the present invention is to provide a closure cap for a product container whereby a double fold hinge attaches the cap to the container adjacent the container opening, whereby the cap, when lifted for opening the container, rotates substantially 180° about the hinge and lies flat relative to the container opening.

Another object of the present invention is to provide a closure cap for a product container wherein the cap is hinged to the container, and the upper surface of the cap incorporates a ridge structure to which thumb pressure is applied beyond the axial center line of the cap in a direction towards the hinge, whereby over-center pressure is applied to the cap, which causes the cap to be pivotally lifted from the opening of the container without contacting portions of the product which may be extending beyond the upper rim of the container under normal conditions of use.

An additional object of the present invention is to provide a closure cap for a product container having a thumb-receiving indentation on top of the cap instead of the side opposite the hinge, which decreases the likelihood that the thumb will contact the product while the cap is being opened.

A further object of the present invention is to provide a closure cap for a product container which cap is mounted to the container by means of a hinge adjacent the upper lip of the container, whereby the relationship between the points of contact between the hinge, the cap and the container are such to allow the cap to be replaced over the open top of the container and not contact any of the product which may protrude from the open top of the container under typical conditions of use.

Still another object of the present invention is to provide a closure cap for a product container which allows the cap, and a collar to which the cap is hingedly affixed, to be molded and cooled in a flat open position for ease of manufacture.

A further object of the present invention is to provide a closure cap connected by a double fold hinge structure to a container, which hinge structure provides a flat opening capability for the cap relative to the container, yet simultaneously provides minimum projection of the hinge beyond the outer diameter of the container when the cap is placed over the open end of the container to close the container.

Another object of the present invention is to provide a closure cap for a product container which cap is specifically designed to avoid the premature opening of the cap when the container is still in the pocket or handbag of the user.

These and other objects of the present invention are provided in a preferred embodiment by a combination of a closure cap pivotally affixed to a collar for a product container by means of a double fold hinge. The collar, cap, and hinge are specifically designed and attached to allow the cap to be rotated away from the container opening by the application of thumb pressure, using the thumb of the same hand that is holding the container. The cap is particularly designed and contoured for the application of thumb pressure to a ridge on the upper surface of the cap, which ridge structure is located beyond the center line of the cap and towards the hinge to typically enable the cap to properly clear the container opening as the cap is rotated to its open position. The collar contains a first portion which abuts the edge of the cap to tightly close the container when the cap is placed over the container opening. The collar also includes a second portion which snugly engages the cap when the cap is placed in its closed position. The unique design of the cap avoids situations where the cap is prematurely lifted to open the container.

Further objects and advantages of the present invention will become apparent from the following description which describes the novel features which characterize the invention, as defined by the claims annexed to and forming a part of this specification.

DESCRIPTION OF THE PREFERRED EMBODIMENT

Figure 1:
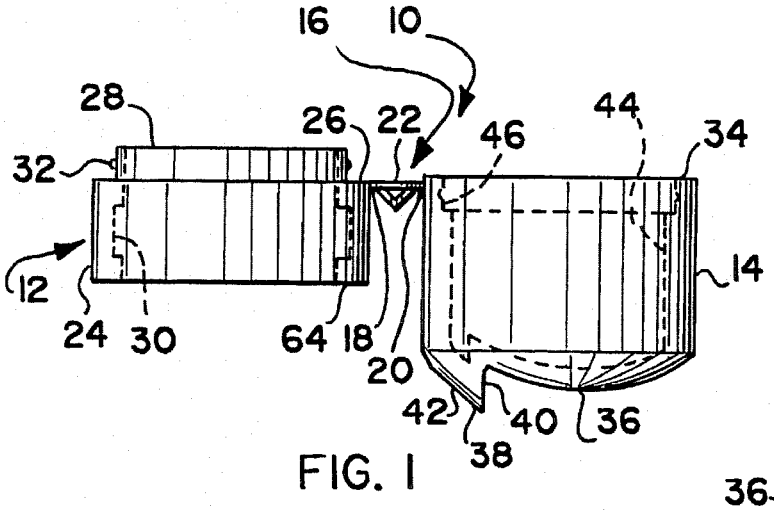
FIG. 1 is an elevation view of the closure cap, collar and hinge assembly constructed in accordance with the teachings of the present invention, showing the cap and collar in their flat, fully opened position.

Referring to FIG. 1, the closure assembly of the present invention is generally designated by the numeral 10, and comprises a circular collar 12 to which a circular cap 14 is pivotally attached by means of a hinge element 16. In the preferred embodiment, the hinge element 16 is a double fold hinge, having two fold lines 18 and 20 separated by a hinge body portion 22 to provide strength to the hinge 16. The double fold configuration of the hinge 16 provides minimum lateral hinge projection beyond the outer diameter of collar 12 and the container to which collar 12 is attached when the cap 14 is in its closed position. This allows the maximum amount of product containers to be displayed in retail dispensing racks without interfering with each other. A first or lower portion 24 of collar 12 has an upper rim 26. A second or upper portion 28 of collar 12 extends upward from rim 26. Collar 12 comprises a hollow, substantially cylindrical central portion 30 which extends through the length of the collar.

One or a plurality of lock tabs 32 extend outwardly from upper portion 28 of collar 12 to provide a releasable locking connection between the cap 14 and collar 12, as will be explained. In the preferred embodiment, fold line 18, where hinge element 16 is connected to collar 12, is located at or near the rim 26, whereby the fold line 18 is located as high as possible on collar 12 and ultimately as high as possible on the product container. This allows the lower lip or rim of cap 14 to clear the product in the container under normal conditions when the cap is moved between its opened and closed position, and the cap 14 doesn't extend too far away from the collar 12 during movement to its open position.

Likewise, fold line 20, which defines where hinge element 16 is pivotally connected to cap 14, is located far enough from the plane of rim 26 so that the bottom edge of the cap 14 doesn't hook on rim 26 or the top of the upper portion 28 of collar 12. This permits proper closure of the cap 14 over the collar 12 regardless of the sequence in which hinge element 16 folds, as will be explained.

Figure 3:
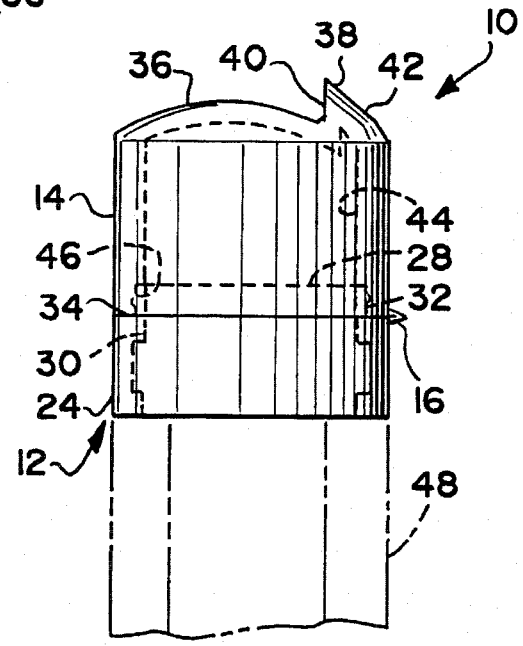
FIG. 3 is an elevation view of the cap, collar, and hinge combination of the present invention, illustrating the collar in place adjacent the open top of a tubular container, and the cap is in its closed position.

The cap 14 is cylindrical in overall configuration, and preferably has the same outer diameter dimension as lower portion 24 of collar 12, whereby the outer sidewall of cap 14 fits flush with the outer sidewall of the lower portion 24 of collar 12 when the cap is rotated about hinge element 16 to the position shown in FIG. 3. As will be explained, due to the construction of hinge element 16 and the locations of its points of attachment to collar 12 and cap 14, the lower rim 34 of cap 14 does not contact or interfere with upper portion 28 of collar 12 as the cap 14 moves to or from its closed position. Also, the construction of the present invention allows the cap 14 to rotate between its opened and closed positions without, under normal conditions, contacting the product held in the tube with which the cap is associated, even though the product may extend somewhat from the tube, typically about one-eighth inch.

Figure 2A:
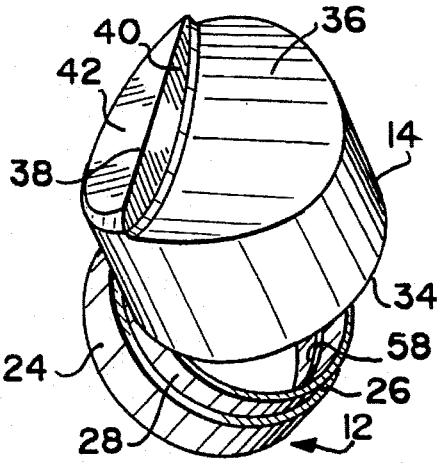
FIGS. 2A and 2B are perspective views of the cap, collar and hinge combination of the present invention, showing front side and back side views, respectively, of the cap fully opened relative to the collar.
Figure 2B:
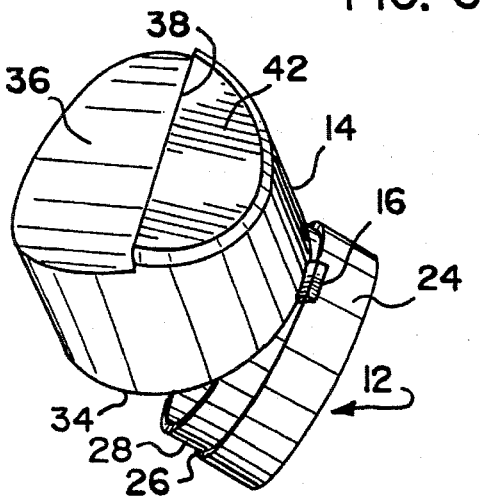

FIGS. 2A and 2B illustrate front and back perspective views of the cap 14 rotated one hundred eighty degrees about hinge element 16, whereby the cap 14 is not seated on collar 12 to form a closure. FIGS. 2A and 2B also illustrate the construction of the upper surface of cap 14 which imparts to the cap the ability to be opened with one hand, and at the same time avoids the premature dislodging of the cap 14 from the closure 12. To this end, the top of cap 14 is formed with a partial concave surface 36 which is adapted to be contacted by the thumb of a user. Partially across the top of cap 14, on a horizontal chordal line located between the imaginary vertical and axial center line of the cap 14 and the hinge element 16 is a ridge 38 that includes a vertical wall 40 and a flat angularly disposed surface 42. The chordal line that defines ridge 38 is also disposed parallel to hinge element 16. Flat surface 42 slants downward from the upward tip of ridge 38 to the outer wall of cap 14 in a direction towards hinge element 16.

The central cavity 44 of cap 14 is hollow and is adapted to be seated over collar 12 when cap 14 is in its closed position (FIG. 3). The inner surface of lower rim 34 of cap 14 is defined by an indented portion 46 having an inner diameter dimension substantially the same as the outer dimension of upper portion 28 of collar 12. When cap 14 is rotated to its closed position as viewed in FIG. 3, the indented portion 46 of cap 14 fits snugly over upper portion 28 of the collar, allowing the cap 14 to fit flush with the lower portion 24 of the collar. Lock tabs 32 abut indented portion 46 when the cap is closed to removably secure the cap in its closed position.

Figure 4:
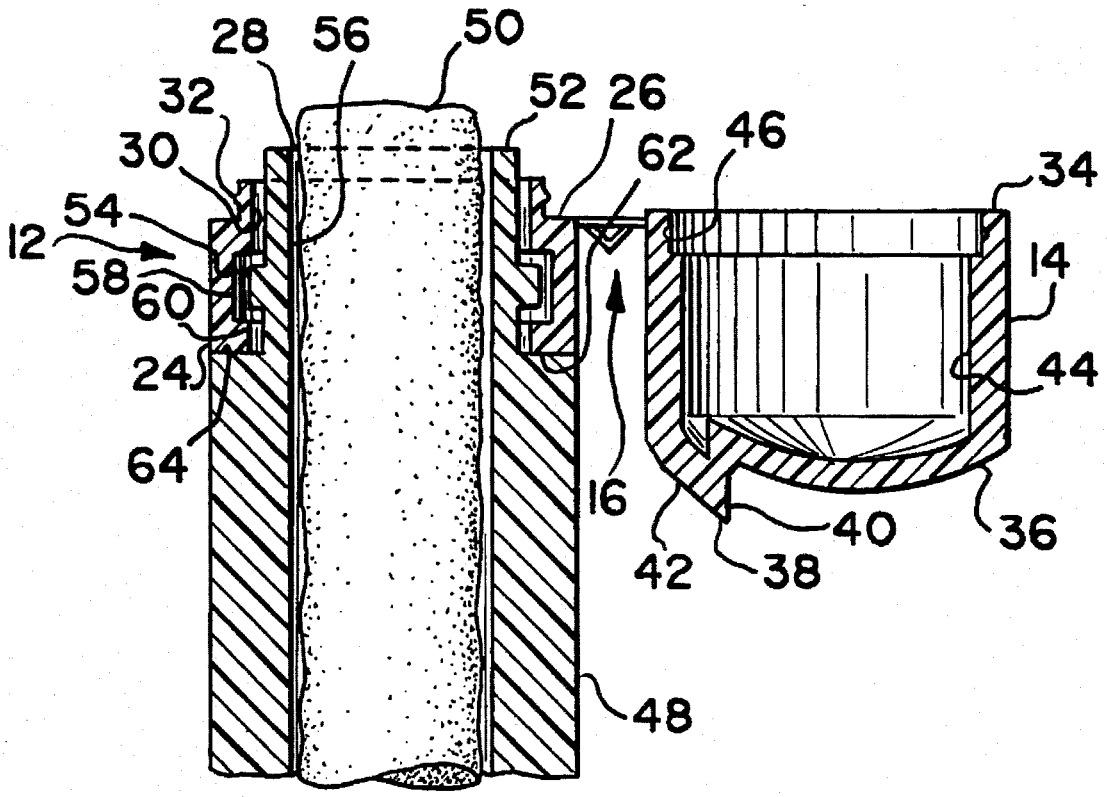
FIG. 4 is a cross-sectional view of the cap, collar and hinge combination of the present invention, illustrating the cap in its open position, and the collar located adjacent the top of a tubular product container, which is also shown in cross section.

FIG. 4 illustrates the closure assembly 10 mounted on a hollow cylindrical tube 48 which is preferably closed at a lower end (not shown) and holds a tubular product 50, such as a lip balm in a wax base, by way of example. The product 50 is preferably sequentially moved upwards as viewed in FIG. 4 as the product is consumed, by screw or lever mechanisms which are known in the art. In FIG. 4, the product 50 is shown extending slightly above the upper lip 52 of tube 48, whereby the product is exposed for use.

To readily mount the collar 12 on tube 48, the tube 48 comprises a ring 54 molded into an upper neck portion 56 of the tube. The ring 54 is adapted to snugly fit into and engage groove 58 circumscribing the inner wall 60 of collar 12. Groove 58 and ring 54 are dimensioned such that collar 12 can be placed downward over neck portion 56 so that ring 54 snaps into groove 58 and holds the collar 12 firmly to the neck portion 56 of the tube. The tube 48 includes a horizontally disposed rim 62 where neck portion 56 is connected to the tube, and the lower rim 64 of collar 12 rests on top of rim 62 when collar 12 is set in place over neck portion 56.

In operation, with cap 14 in its closed position over collar 12 as illustrated in FIG. 3, the tube 48 is manually gripped in one hand, and the thumb of the same hand is placed on the concave surface 36 of cap 14, and pressure is applied to vertical wall 40. Since the chordal line which forms ridge 38 and defines the location of vertical wall 40 is beyond the vertical center line of cap 14 in the direction of application of thumb pressure, and since vertical wall 40 extends parallel to hinge element 16, the thumb pressure is sufficient to lift cap 14 free of lock tabs 32, and to rotate cap 14 about hinge element 16 until the cap assumes the position shown in FIG. 1. The curvature of concave surface 36 of cap 14, and the proximity of surface 36 to vertical wall 40 provides a cavity for positive engagement of the thumb when the cap 14 is being lifted to open the tube 48. As a result, the thumb remains engaged with concave surface 36, and the thumb is prevented from slipping off the cap 14 into the product 50 in the container.

As cap 14 rotates, hinge element 16 pivots about fold lines 18 and 20 substantially simultaneously, allowing the lower rim 34 of cap 14 to clear upper portion 28 of collar 12 and the upper edge of product 50 as the cap rotates to the open position. This clearance feature of the present invention is also a function of the fact that fold line 18 is located adjacent upper rim 26 of the lower portion 24 of collar 12, combined with the location of fold line 20 at a small distance from the lower rim 34 of cap 14. Also, the upper edge of concave surface 36 extends to and is flush with ridge 38, such that concave surface 36 does not extend upward beyond ridge 38. This avoids situations where items such as found in a pocket or handbag of a user from engage ridge 38 with a force that would prematurely open cap 14.

When cap 14 is moved to its opened configuration as shown in FIGS. 1 and 4, the hinge construction described above produces an increased hinge memory, whereby the cap substantially returns to its flat open position each time it is opened, and avoids contacting a users nose when the lip balm product 50 in tube 48 is used. The hinge memory in the closure assembly 10 is established when the cap, collar, and hinge elements are molded and cooled in the flat open position, with the hinge at a 180° angle, as shown in FIGS. 1 and 4.

The two fold line construction of hinge element 16 allows the hinge element profile to extend a minimum distance outward from the outer wall of cap 14 and collar 12 when the cap is closed over the collar. This provides greater quantity display capabilities for the product with which closure assembly 10 is utilized. Further, the combination of the collar, hinge and cap construction set forth above allows the cap to extend outward only a minimum distance when fully opened. This is important when it is desired to prevent the cap from contacting adjacent facial or body features when the product 50 is used for its intended purpose.

When the cap 14 is moved to either its opened or closed position, the double fold lines 18, 20 of hinge element 16 allow the lower portion of the cap to clear the upper portion 28 of collar 12, regardless of the sequence in which the fold lines 18, 20 function.

Further modifications and embodiments of the presently disclosed invention will be readily apparent to those skilled in the art, and it is intended that the scope of the invention be determined by the appended claims and their equivalent structures.

We claim:

1. A closure for a container comprising:

a collar adapted to snugly engage a portion of the container;

said collar having a cap engaging portion adapted to fit inside a cap when said cap is removably placed over said collar portion;

hinge means attaching said cap to said collar for pivotal movement of said cap relative to said collar whereby the arc of travel of said pivoting cap causes said pivoting cap to clear said cap engaging portion of said collar when said cap is pivoted about said hinge means and placed over said cap engaging portion;

said hinge means essentially consisting of a single unitary member integrally formed between said cap and said collar;

said hinge means having a body portion, said body portion attached to said cap and said collar along only a single uninterrupted portion of an outer sidewall of said cap and said collar, respectively; and said body portion having two fold lines, each fold line being disposed on opposite sides of said body portion and disposed transverse to said arc of travel of said pivoting cap.

2. The closure of claim 1 wherein one of said fold lines is adjacent said collar.

3. The closure of claim 2 wherein the second of said fold lines is adjacent said cap.

4. The closure of claim 1 wherein said cap engaging portion is disposed concentrically on an upper portion of the collar, said cap engaging portion having an outside diameter less than an outside diameter of said collar such that a rim portion is formed between the collar and the cap engaging portion, and one of two said fold lines is formed on the rim.

5. The closure of claim 1 wherein the distance between said two fold lines is sufficient to prevent a bottom rim of said cap from engaging an upper rim of said cap engaging portion of said collar when said cap is pivoted into engagement with said cap engaging portion of said collar.

6. A closure for a container comprising:

a collar adapted to snugly engage a portion of the container;

said collar including a first portion having a first outer diameter and a second portion having a second outer diameter, said second outer diameter being less than said first outer diameter;

said first portion of said collar having an upper rim where said first portion and said second portion of said collar meet;

hinge means having one end attached to said first portion of said collar and a second end attached to a cap;

said cap including a lower portion having a first inner diameter and an upper portion having a second inner diameter, said first inner diameter being substantially the same dimension as the outer diameter of said second portion of said collar whereby said lower portion of said cap fits snugly over said second portion of said collar when said cap is removably placed over said collar by pivoting said cap about said hinge means;

said hinge means essentially consisting of a single unitary member integrally formed between said cap and said collar;

said hinge means having a body portion, said body portion attached to said cap and said collar along only a single uninterrupted portion of an outer sidewall of said cap and said collar, respectively;

said body portion having two fold lines, each fold line being disposed on opposite sides of said body portion; and said hinge means attached to said first portion of said collar and said cap in relative positions whereby said lower portion of said cap clears and extends over the second portion of said collar when said cap is positioned over said collar and said cap lies in a substantially flat position extending outward from said collar when said cap is rotated out of engagement with said collar.

7. The closure of claim 6 wherein said hinge means is a double fold hinge having two fold lines, whereby the lower portion of said cap clears and fits over the second portion of said collar when said cap is positioned over said collar regardless of the sequence in which the hinge folds about said two fold lines.

8. The closure of claim 6 wherein said one end of said hinge means is attached to said first portion of said collar adjacent said upper rim.

9. A closure for a container having an opening comprising:

a cap pivotally attached by hinge means to an element of said container, said cap adapted to move from a first position engaging the top of said container to a second position out of engagement with the top of said container;

said cap having a finger engaging portion at the top of said cap;

said finger engaging portion having a ridge element extending chordally along the top of said cap, said ridge element extending parallel to said hinge means, whereby the application of lateral pressure to said ridge element causes said cap to rotate about said hinge means and open said container;

said cap including an upper surface adjacent said chordal ridge element, said upper surface comprising a concave surface for the accommodation of thumb pressure applied to said chordal ridge; and a wall extending between said chordal ridge and said concave surface to form a cavity to positively engage the thumb when applied to the chordal ridge to mitigate against the thumb slipping off of said cap.

10. The closure of claim 9 wherein said element of said container comprises a collar snugly affixed to said container adjacent said opening, and said hinge means pivotally attach said cap to said collar.

11. The closure of claim 9 wherein said chordal ridge is located between the axis of said cap and the edge of said cap attached to said hinge means, whereby said pressure applied to said ridge element causes over center pivoting of said cap relative to said container.

12. The closure of claim 9 wherein said concave surface laterally extends upward to engage each end of said chordal ridge.

* * * * *